US006465944B1

(12) United States Patent
New

(10) Patent No.: US 6,465,944 B1
(45) Date of Patent: Oct. 15, 2002

(54) SPACE-SAVING CATHODE RAY TUBE EMPLOYING A SIX-POLE NECK COIL

(75) Inventor: David A. New, Mercerville, NJ (US)

(73) Assignees: Sarnoff Corporation, Princeton, NJ (US); Orion Electric Company, Ltd., Kyung-Bukm (KR)

( * ) Notice: Subject to any disclaimer, the term of this patent is extended or adjusted under 35 U.S.C. 154(b) by 0 days.

(21) Appl. No.: 09/849,154

(22) Filed: May 4, 2001

Related U.S. Application Data

(60) Provisional application No. 60/207,249, filed on May 26, 2000.

(51) Int. Cl.[7] ..... H01J 29/68
(52) U.S. Cl. ..... 313/442; 313/440
(58) Field of Search ..... 313/422, 442, 313/433, 432, 437, 438, 439, 440; 335/213, 210; 315/368.11, 368.26

(56) References Cited

U.S. PATENT DOCUMENTS 2,721,287 A 10/1955 Van Ormer
3,185,879 A * 5/1965 Evens, Jr. ..... 313/422
3,233,144 A 2/1966 Kuroda et al.
3,983,444 A 9/1976 Odenthal
4,323,816 A 4/1982 Chang
4,329,618 A 5/1982 Chang
4,933,598 A 6/1990 Sudo et al.
5,015,925 A 5/1991 Spanjer et al.
5,070,280 A * 12/1991 Okayama et al. ..... 315/368.11
5,086,259 A * 2/1992 Sakurai et al. ..... 335/213
5,142,205 A * 7/1992 Yabase et al. ..... 315/368.26
5,327,044 A 7/1994 Chen

* cited by examiner

*Primary Examiner*—Michael H. Day
(74) *Attorney, Agent, or Firm*—William J. Burke

(57) ABSTRACT

In a cathode ray tube, an electron beam is directed towards a faceplate having an electrode biased at screen potential and is magnetically scanned across the faceplate to impinge upon phosphors thereon to produce light depicting an image. A six-pole coil is disposed proximate the deflection yoke and/or on the tube neck to modify the focus of the red, green and blue electron beams to control focus. An electrode between the tube neck and the faceplate is biased at or above screen potential to deflect electrons over a greater total angle than is obtained from the magnetic deflection.

2 Claims, 6 Drawing Sheets

SPACE-SAVING CATHODE RAY TUBE EMPLOYING A SIX-POLE NECK COIL

This Application claims the benefit of U.S. Provisional Application Serial No. 60/207,249 filed May 26, 2000.

The present invention relates to a cathode ray tube and, in particular, to a cathode ray tube including a six-pole coil and one or more deflection aiding electrodes.

Conventional cathode ray tubes (CRTs), widely utilized in television and computer displays, employ an electron gun positioned in a neck of an evacuated funnel-shaped glass bulb to direct a number of electron beams, usually three, toward the center of a glass faceplate biased at a high positive potential, e.g., 30 kilovolts (kV). A deflection yoke raster scans the electron beams across the faceplate so that phosphors on the faceplate produce light, thereby to produce an image thereon. The deflection yoke includes a plurality of electrical coils positioned on the exterior of the funnel-shaped CRT near its neck. "Horizontal" coils of the deflection yoke produce magnetic fields that cause the electron beams to deflect or scan from side to side and "vertical" coils thereof produce magnetic fields that cause the electron beams to scan from top to bottom. The deflection yoke typically acts on the electron beams only in the first few centimeters of their travel immediately after exiting the electron guns, and the electrons travel in a straight line trajectory thereafter, i.e through a substantially field-free drift region. Conventionally, the horizontal scan produces hundreds of horizontal lines in the time of each vertical scan to produce the raster-scanned image.

The depth of a CRT, i.e. the distance between the faceplate and the rear of the neck, is determined by the maximum angle over which the deflection yoke can bend or deflect the electron beams and the length of the neck extending rearward to contain the electron gun. Greater deflection angles provide reduced CRT depth.

Modern magnetically-deflected CRTs typically obtain a ±55° deflection angle (referred to as 110° deflection) and for screen diagonal sizes of about 62 cm (about 25 inches) or more are so deep that they are almost always provided in a cabinet that either requires a special stand or must be placed on a floor. For example, a 110° CRT having an about 100 cm (about 40 inch) diagonal faceplate and a 16:9 aspect ratio, is about 60–65 cm (about 24–26 inches) deep. Increasing the maximum deflection angle so as to reduce the depth of the CRT is disadvantageous and/or impractical due to, e.g., increased power dissipation, greater temperature rise, and the higher cost.

One approach to this depth dilemma has been to seek a thin or so-called "flat-panel" display. Flat panel displays, while thin enough to be hung on a wall, require very different technologies from conventional CRTs which are manufactured in very high volume at reasonable cost. Thus, flat panel displays are not available that offer the benefits of a CRT at a comparable cost.

In a short depth or space saving tube, it is necessary that the three beams of electrons be converged on the screen and be symmetrical. Conventional approaches do not provide a solution to this problem.

Accordingly, there is a need for a cathode ray tube adaptable for having a depth that is less than that of a conventional CRT having an equivalent screen-size in which the electron beams are substantially symmetrical at the screen.

To this end, the tube of the present invention comprises a tube envelope having a faceplate defining a center and a periphery, and having a screen electrode on the faceplate adapted to be biased at a screen potential, a source of a beam of electrons directed to impinge on the faceplate, a deflection yoke for magnetically deflecting the beam of electrons on the faceplate at a scanning rate, phosphorescent material disposed on the faceplate for producing light in response to the beam of electrons impinging thereon, and a source of a six-pole magnetic field for focusing the beam of electrons when the beam of electrons is deflected to impinge near the periphery of the faceplate.

BRIEF DESCRIPTION OF THE DRAWING

The detailed description of the preferred embodiments of the present invention will be more easily and better understood when read in conjunction with the FIGURES of the Drawing which include.

Figure 1:
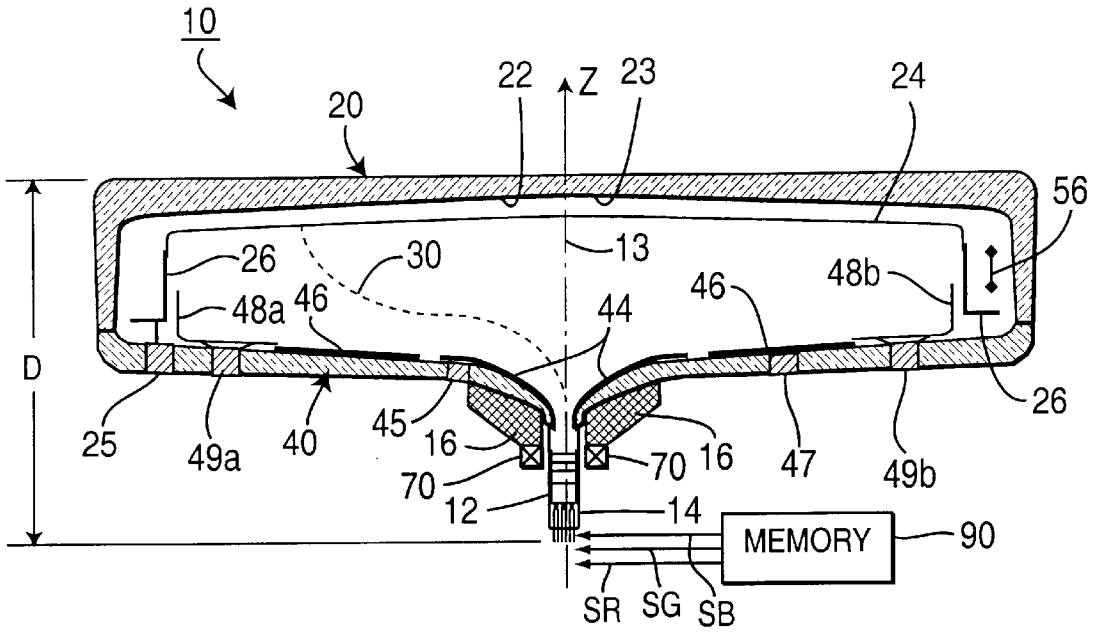
FIG. 1 is a cross-sectional schematic diagram of an exemplary embodiment of a cathode ray tube in accordance with the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on. It is noted that, according to common practice, the various features of the drawing are not to scale, and the dimensions of the various features are arbitrarily expanded or reduced for clarity.

DESCRIPTION OF THE PREFERRED EMBODIMENTS

In a cathode ray tube according to the present invention, the electrons of the electron beam(s) are further deflected after leaving the influence of the magnetic deflection yoke, i.e. in what is referred to as the "drift region" of a conventional CRT through which the electrons travel in substantially straight lines. In a conventional CRT, the electrons are at the screen or anode potential at the time they leave the gun and deflection regions and, not being under the influence of any electric or magnetic field, travel in straight lines to the screen or faceplate thereof. Such cathode ray tube may find application, for example, in television displays, computer displays, projection tubes and other applications where it is desired to provide a visual display.

FIG. 1 is a cross-sectional diagram of a cathode ray tube 10 according to the present invention. It is noted that unless otherwise specified, such cross-sectional diagrams may be considered to illustrate either the horizontal or the vertical deflection orientation because both appear similar in such diagrams. Electrons produced by electron gun 12 located in tube neck 14 are directed towards faceplate 20, which includes a screen or anode electrode 22 biased at a relatively high positive potential, and are deflected by magnetic fields produced by deflection yoke 16 to scan across faceplate 20. Electrodes 44, 46, 48 on tube envelope 40 are biased to predetermined potentials to establish electrostatic fields within tube envelope 40 to deflect electron beams 30 away from the tube 10 centerline further than they are deflected by the magnetic field produced by deflection yoke 16.

A coating of phosphorescent material 23 is disposed on faceplate 20 for producing light in response to the beam of electrons 30 impinging thereon, thereby providing a monochromatic display, or a pattern of different phosphorescent materials 23 is disposed thereon for producing different colors of light in response to the plural beams of electron beam 30 impinging thereon through apertures in shadow mask 24, thereby providing a color display. Usually, the three beams of electron beam 30 are referred to as the "red R beam," the "green G beam," and the "blue B beam" indicating the beams that are intended to illuminate the red phosphor, the green phosphor and the blue phosphor, respectively, of phosphor 23.

Six-pole coil 70 is disposed on tube neck 14 proximate deflection yoke 16 and the exit of electron gun 12 and produced a six-pole magnetic field that simultaneously affects the focus of the red, green and blue electron beams of electron beam 30 differently. Specifically, six-pole coil 70 is utilized to obtain balance of the focus of the red, green and blue electron beams at the side vertical edges of screen 22 on faceplate 20 of tube 10. Coil 70 may be made as part of deflection yoke 16 or may be separate therefrom and mounted on tube neck 14, as may be convenient for fabrication and assembly of yoke 16 and tube 10.

Electron beam focus generally refers to the shape of the electron beam at landing as defined by a contour representing a given distribution of the electrons of the electron beam. For example, a closed contour within which 95% of the electrons of the electron beam land could be used to evaluate electron beam focus. Preferably, such contour is circular and is of small diameter, and the electron distribution within the contour is relatively uniform. As a practical matter, however, such perfection is rarely achieved, and so a generally circular focus contour and a generally uniform distribution is sought, within a diametric dimension that is close to the size of the pixel area of phosphor that the electron beam is intended to illuminate.

In particular, the six-pole electromagnetic field produced by six-pole coil 70 affects the distribution of the electrons in the three beams R, G, B simultaneously so that to the extent they would be unfocused or asymmetric at their landing on screen 22 and phosphor 23, such un-focus or asymmetry is substantially reduced. Because greater correction of focus or asymmetry is needed at the vertical edges of screen 22 and little correction is needed at the center thereof, six-pole coil 70 is driven with a current waveform that has a minimum amplitude, typically zero, when scanning electron beam is at the center of screen 22, and a maximum amplitude when it is at the left and right vertical edges. Thus, such current waveform has a repetition rate that is the same as the horizontal scanning rate. Six-pole coil 70 and its effect on the respective electron distribution of the R, G, B electron beams 30 is described below.

Electrostatic fields are established within tube 10 by a number of conductive electrodes located on or close to backplate 40 and biased at respective positive potentials, i.e. at potentials of like polarity to that of the screen or anode electrode 22. The bias potentials on electrodes 44, 46, 48 of tube 10 provide an electrostatic field to control the trajectories of the electrons of electron beam 30, thereby to reduce the required distance between the faceplate 20 and electron gun 12 of exemplary tube 10, and to change the landing angle of the electron beam 30 therein.

First electrode 44 surrounds the outlet of gun 12 in the vicinity of neck 14 and is biased at a positive potential that is preferably less than the potential at screen electrode 22. The electrostatic field produced by electrode 44 results in the electrons of the electron beam 30 being slower moving proximate yoke 16, and therefore more easily deflected thereby. The result of the cooperation between electrode 44 and yoke 16 may be utilized to realize either a reduction of yoke power, and therefore a smaller, lighter, less expensive and likely more reliable deflection yoke 16, or a greater deflection angle with the same yoke power and yoke.

Second electrode 46 also surrounds the outlet of gun 12, but is spaced away from neck 14, and is biased at a positive potential that is preferably greater than the potential at screen electrode 22. The electrostatic field produced by second electrode 46 causes the electrons of beam 30 to travel in a parabolic path that bends their trajectories away from faceplate 20, thereby increasing the deflection angle from that produced by magnetic deflection yoke 16 alone, and also decreasing the "landing angle" of electron beam 30. Electrode 46 is desirably positioned so that its electrostatic field does not act on the electrons of electron beam 30 until after they have been substantially fully acted upon by deflection yoke 16.

The "landing angle" is the angle at which electron beam 30 impinges upon screen electrode 22, and in a color CRT, the shadow mask 24 proximate thereto. As a result of the action of the field of electrode 46, the landing angle becomes smaller as the distance from the central or Z axis of tube 10 becomes greater and/or as the deflection angle of electron beam 30 increases. Because shadow mask 24 has a finite non-zero thickness, if the landing angle is too small, e.g., less than about 25°, too many of the electrons will hit the sides of the apertures in shadow mask 24 instead of passing therethrough, thereby reducing the intensity of the electron beam reaching phosphor 23 on the faceplate 20 and of the light produced thereby.

Advantageously, electrode 48 is located distal the central or Z axis of tube 10 and near the periphery of faceplate 20 where the landing angle is smallest. Electrode 48 surrounds the outlet of gun 12, but substantially at the periphery of backplate 40, and is biased at a positive potential that is preferably less than the potential at screen electrode 22 to direct electron beams 30 back towards faceplate 20 for increasing the landing angle thereof near the periphery of faceplate 20. Electrode 48 may be biased to a potential less than the potential at neck electrode 44 where desired to provide greater reduction of landing angle. Thus, the electrostatic fields created by electrodes 46 and 48 complement each other in that electrode 46 increases the deflection angle which decreases the landing angle at the periphery of faceplate 20, and electrode 48, which has its strongest effect near the periphery of faceplate 20, acts to increase the landing angle in the region where it might otherwise be undesirably small.

Figure 2:
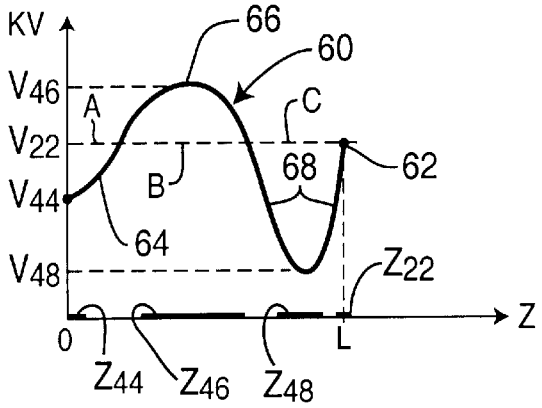
FIG. 2 is a graphical representation of the potential in the cathode ray tube of FIG. 1.

The relationship and effects of the electrostatic fields described above cooperate in a tube 10 that is shorter in depth than a conventional CRT and yet operates at a comparable and/or reasonable deflection yoke power level. An exemplary potential distribution over the depth of tube 10 along its Z axis is illustrated in FIG. 2. Potential characteristic 60 is plotted on a graph having distance from the exit of gun 12 along the ordinate and bias potential in kilovolts along the abscissa. Electrode 22 located at a distance L from gun 12 and represented by region $Z_{22}$ is biased at a relatively high positive potential $V_{22}$ represented at point 62. In order from gun 12 at Z=0 are neck electrode 44 located proximate gun 12 and represented by electrode region $Z_{44}$ that is biased at an intermediate positive potential $V_{44}$, electrode 46 located intermediate gun 12 and faceplate 20 and represented by electrode region $Z_{46}$ that is biased at a relatively high positive potential $V_{46}$ that is preferably higher than the screen potential $V_{22}$, and electrode 48 located more proximate to faceplate 20 and represented by electrode region $Z_{48}$ that is biased at an intermediate positive potential $V_{48}$ that is preferably lower than screen potential $V_{22}$ (but could be equal thereto) and could preferably be lower than gun ultor potential $V_{44}$.

Electrodes 44, 46, 48, 22 and bias potentials $V_{44}$, $V_{46}$, $V_{48}$, $V_{22}$ thereon produce potential characteristic 60 that has a portion 64 in region A rising towards the screen potential $V_{22}$ thereby tending to slow the acceleration of electrons towards faceplate 20 to provide additional flight time during which the subsequent electrostatic fields act upon the electrons. Characteristic 60 has a portion 66 in region B in which the potential peaks at a level relatively higher than the screen potential $V_{22}$ thereby to cause the electrons to move along trajectories that depart further from central axis Z of tube 10 to increase the deflection angle and a portion 68 in region C in which the potential bottoms at a level lower than the screen potential $V_{22}$ and the gun potential $V_{44}$ thereby to cause the electrons to move along trajectories that turn toward faceplate 20 of tube 10 to increase the landing angle of electron beam 30 near the edges thereof.

It is noted that the location of the gap between electrodes 44 and 46 can strongly affect the operation of tube 10. If electrode 46 having a relatively very high positive potential bias extends too close to the exit of gun 12 (and/or neck electrode 44 does not extend sufficiently far therefrom), then the electrons emitted from gun 12 are accelerated and additional magnetic deflection effort is required of deflection yoke 16 (e.g., additional yoke power, field and/or size) to provide the desired magnetic deflection. On the other hand, if neck electrode 44 extends too far beyond the exit of gun 12, then the electrons spend too much time in region A in which electrostatic forces act counter to the deflection sought to be produced by magnetic deflection yoke 16, thereby increasing the power, field and /or size required of yoke 16 to deflect the electron to the corners of faceplate 20, even with the beneficial effect of electrode 46.

The particular values of bias potential are selected in accordance with a particular tube 10 to obtain, for example, a suitable balance of reduced tube depth and reasonable yoke power in consideration of the effects of each of the bias potentials. For example, as the bias potential $V_{44}$ of the ultor of gun 12 is increased, the required deflection power of yoke 16 increases and the depth of tube 10 decreases, indicating that a bias potential of intermediate value is desirable. Thus, a 165° tube with $V_{22}$=30 kV and $V_{44}$=20 kV is about 13.5–15 cm (about 5.4–6 inches) shorter than a conventional 110° CRT. A constant bias potential $V_{46}$ on electrode 46 causes the electrons to follow a substantially parabolic trajectory toward faceplate 20 in region B, however, increasing the bias potential $V_{46}$ reduces the electrostatic forces pulling electrons towards faceplate 20, so that a bias potential $V_{46}$ that is near or greater than the screen potential $V_{22}$ is advantageous to cause the electrons to travel in a more nearly straight line trajectory or to curve away from faceplate 20, thereby to increase the deflection angle and reduce the depth of tube 10. Thus, a bias potential $V_{46}$ of about 30–35 kV is desirable, which, for safety, is below the potential at which X-rays that could penetrate the envelope of tube 10 could be generated. Finally, bias potential $V_{48}$ is preferably a low positive potential to provide an electrostatic force that turns the electrons deflected to the edge regions of faceplate 20 more toward faceplate 20 to increase the landing angle, preferably to above 25°. This field accelerates the electrons towards faceplate 20 subsequent to their being deflected by yoke 16 and the electrostatic field forces produced by bias potential $V_{46}$ and electrode 46.

For example, tube 10 of FIG. 1 may be an about 810-mm (about 32-inch) diagonal 16:9 aspect ratio format cathode ray tube having a viewable area of 660 mm (about 26 inch) width and 371 mm (about 14.6 inches) height. As a result of the reduced tube depth of the present invention, tube 10 has a depth D of about 280 mm (about 11 inches). Deflection yoke 16 may be a 110° or a 125° saddle-saddle type deflection yoke including a saddle-type horizontal coil, a saddle-type vertical coil, a ferrite core and a pair of permeable metal shunts for shaping vertical deflection for self convergence. With the 125° deflection-angle yoke, the diameter of tube neck 14 may be reduced to allow use of a smaller, lower power yoke 16. Preferably, deflection yoke 16 is a non-converging (non-self-converging) deflection yoke providing a total deflection angle of about 135–140° wherein each of the horizontal and vertical deflection coils is of the saddle-type. Specifically, at least the horizontal deflection coil preferably has a non-uniform distribution of turns so that the number of turns effective at the entrance of the yoke (i.e. the end proximate electron gun 12) is substantially greater than the number of turns effective at the exit from the yoke (i.e. the end distal electron gun 12). The distribution of turns typically decreases monotonically between the yoke entrance and exit, but not necessarily linearly, as is determined by the particular arrangement of the shape and electrode arrangement of the cathode ray tube 10, the bias potentials to be applied thereto, and the desired characteristics.

Cathode ray tube 10 employs a combination of electrodes including conductive coatings on tube enclosure 40 and metal electrodes supported within tube envelope 40. Neck electrode 44 is a conductive coating on the wall of tube envelope 40 and is biased at a potential applied via feedthrough 45 penetrating the wall of tube envelope 40. The low bias potential of neck electrode 44, e.g., 10–20 kV and typically about 15 kV, tends to slow the electrons thereby increasing the effectiveness of magnetic deflection yoke 16. Deflection-enhancing electrode 46 surrounds neck electrode 44 and is a conductive coating biased at a potential, e.g., 35 kV, that exceeds the screen potential and is applied via feedthrough 47 penetrating the wall of tube envelope 40. The electric field produced by electrode 46 acts on the electrons of electron beam 30 after the deflection thereof by yoke 16 is substantially completed, thereby to increase deflection of the electron beam 30 beyond that provided by deflection yoke 16.

Third electrode 48 is biased at a potential that is applied via feedthroughs 49 penetrating the wall of tube envelope 40. Electrode 48 is biased at a potential that is less than the screen potential and preferably less than the neck electrode 44 potential, e.g., 0–20 kV and typically about 10 kV, thereby to direct the electrons reaching the peripheral regions of faceplate 20 towards faceplate 20, thereby to decrease their landing angle. Because faceplate 20 is much shorter in the vertical dimension than in the horizontal dimension (which is illustrated in FIG. 1), electrode 48 need not be rectangular as described above so as to act on electrons directed toward the top and bottom edges of the viewable area of faceplate 20, but may be two straight L-shaped formed metal electrodes 48*a*, 48*b* receiving bias potential via feedthroughs 49*a*, 49*b*, respectively, to act only on those electrons directed towards the left and right vertical edges of tube 10. Electrodes 48*a*, 48*b* are supported by feedthroughs 49*a*, 49*b*, respectively, such as by a weld or a conductive glass frit to metal attachment.

Shadow mask 24, supported by shadow mask frame 26, receives screen electrode 22 bias potential, e.g., 30 kV, via feedthrough 25 penetrating the wall of tube envelope 40. Barium getter material 56 is placed at convenient locations, such as behind shadow mask frame 26 and electrodes 48*a*, 48*b*.

A conductive coating or electrode on the inside surface of tube 40, such as on faceplate 20 or glass envelope 40, is preferably a sprayed, sublimated, spin coated or other deposition or application of graphite, carbon or carbon-based materials, aluminum or aluminum oxide, or iron oxide, or other suitable conductive material. Where electrodes, such as electrodes 48*a*, 48*b*, are spaced away from the wall of tube envelope 40, such electrodes are preferably formed of a suitable metal such as a titanium, Invar alloy, steel, stainless steel, or other suitable metal, and are preferably stamped. If magnetic shielding is desired to shield electron beam 30 from unwanted deflection caused by the earth's magnetic field and other unwanted fields, a magnetic shielding metal, such as mu-metal, steel, or a nickel-steel alloy, may be employed.

It is noted that shaping backplate 40 (i.e. the glass funnel of tube 10) to more closely conform to the trajectories of the furthest deflected electron beams 30 improves the effectiveness of the electrostatic forces produced by electrodes 44, 46, 48, thereby to reduce the depth of tube 10. In addition, the gradual potential change over distance illustrated in FIG. 2 allows a larger diameter electron beam 30 at he exit of gun 12, thereby reducing space charge dispersion within electron beam 30 to provide a desirably smaller beam spot size at faceplate 20. The spot size and divergence of electron beam 30 is controlled by the particular electron gun and the convergence of the desired yoke.

Figure 3:
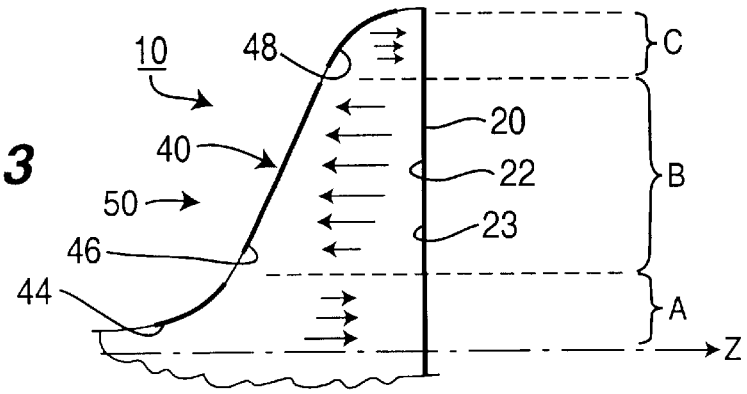
FIG. 3 is a cross-sectional diagram of the tube of FIG. 1 illustrating the electrostatic forces therein.

FIG. 3 illustrates tube 10 (only half of tube 10 being illustrated because of symmetry about the Z axis, i.e. in what could be designated the X plane and the Y plane) as described above having electrodes 22, 44, 46, 48 biased to produce a potential distribution as in FIG. 2. Electron beams 30 are not illustrated, but arrows are shown directed either towards or away from faceplate 20 representing the net electrostatic force acting on the electrons of beam 30 as they pass through the regions A, B and C as described above. In region A, the net electrostatic force directs electrons towards faceplate 20 under the influence of the relatively high positive bias potential $V_{22}$ of screen electrode 22 and the intermediate positive bias potential $V_{44}$ on electrode 44. In region B, the net electrostatic force deflects electrons away from faceplate 20 under the influence of the relatively very high bias potential $V_{46}$ on electrode 46, i.e. greater than screen potential $V_{22}$. In region C, the net electrostatic force again directs the electrons towards faceplate 20 under the influence of the screen potential $V_{22}$ as assisted by the low positive bias potential $V_{48}$ on electrode 48.

It is noted that the effect of the electrostatic force produced by the relatively very high bias potential on electrode 46 (i.e. higher than the bias potential $V_{22}$ of screen electrode 22) is to increase deflection of electron beam 30 beyond that produced by the magnetic deflection of yoke 16. Because electrode 46 acts to amplify the total deflection above that produced by yoke 16, it may be referred to as "yoke amplifier" 50. In particular, the deflection amplification produced by yoke amplifier 50 is directly proportional to the deflection of any particular electron by yoke 16. In other words, electrons moving towards faceplate 20 along or near the Z axis (i.e. those undeflected or little deflected by yoke 16) are not affected by yoke amplifier 50. Those electrons deflected by yoke 16 to land intermediate the Z axis and the edge of faceplate 20 are additionally deflected by yoke amplifier 50 because they pass through a portion of region B in which yoke amplifier 50 acts. Those electrons deflected by yoke 16 to land near the edge of faceplate 20 are additionally deflected an even greater amount by yoke amplifier 50 because they pass through the entirety of region B in which yoke amplifier 50 acts and so are more strongly affected thereby. Yoke amplifier 50 may also be considered to include electrode 44 which, when biased at a potential less than the screen potential, beneficially reduces the effort or power required by deflection yoke 16 to obtain a given deflection of electron beam 30.

It is also noted that tube 10 may also be advantageous because it "looks like a conventional CRT" with a shaped glass bulb and neck, and a planar or slightly curved faceplate, and so may utilize similar manufacturing processes as are utilized for conventional CRTs. The space charge effects that expand the electron beam are also similar to those in conventional CRTs and so the spot size variation with a smaller spot at the center of the faceplate and a somewhat larger spot size at the edges and corners is similar to that of the conventional CRT, although the structure and operation of tube 10 is very different therefrom. While the substantially reduced front-to-back depth of tube 10 is in the conical section of the glass bulb, the length of the tube neck 14 necessary to contain electron gun 12, typically less than about 23–25 cm (about 9–10 inches), can be reduced if a shorter electron gun 12 is employed.

As used herein, "generally rectangular shape" or "substantially rectangular" refers to a shape somewhat reflective of the shape of faceplate 20 and/or the cross-section of tube envelope 40 when viewed in a direction along Z axis 13. A generally rectangular shape may include rectangles and squares having rounded corners as well as concave and/or convex sides, so as to be suggestive of racetrack shapes, oval shapes and the like. It is noted that by so shaping electrodes 44, 46 and/or 48, the required waveform of the drive current applied to yoke 16 may be simplified, i.e. made closer to a linear waveform. Electrodes 44, 46, 48 may be oval in shape or even almost circular, particularly where the cross-section of tube envelope 40 is of such shape, e.g., at the portions thereof proximate neck 14 and yoke 16.

Figure 4:
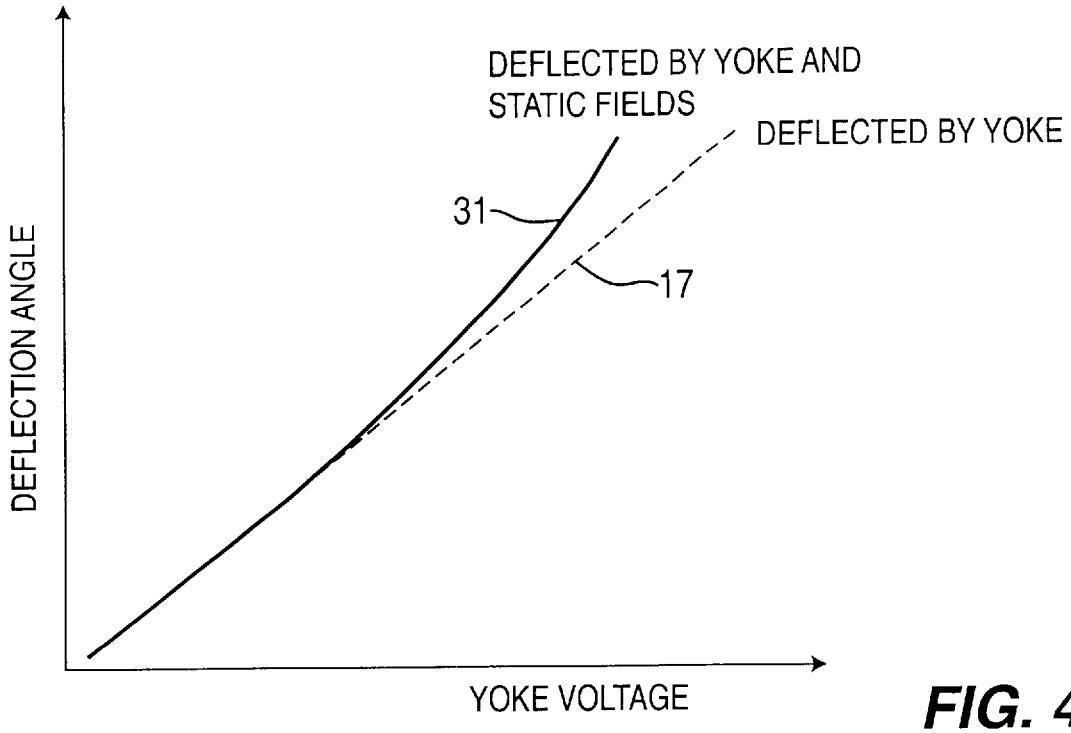
FIG. 4 is a graphical representation illustrating the performance of the cathode ray tube of FIG. 1.

The total deflection angle obtained is the sum of the magnetic deflection angle and the additional electrostatic deflection angle. The magnetic deflection angle is directly proportional to the deflection current/voltage applied to yoke 16 as illustrated by dashed line 17 of FIG. 4 and the additional electrostatic deflection angle is greater for greater magnetic deflections, producing line 31 representing the total deflection angle. The deflection amplifying effect results from the electric field produced by electrode 46 acting on electron beam 30 to produce a net electrostatic force (integrated over the electron path) that pulls the electrons away from centerline 13 of tube 10, thereby increasing the total deflection angle. This effect is aided by the bias potential on electrode 46 being greater than the potential of screen electrode 22.

Figure 5:
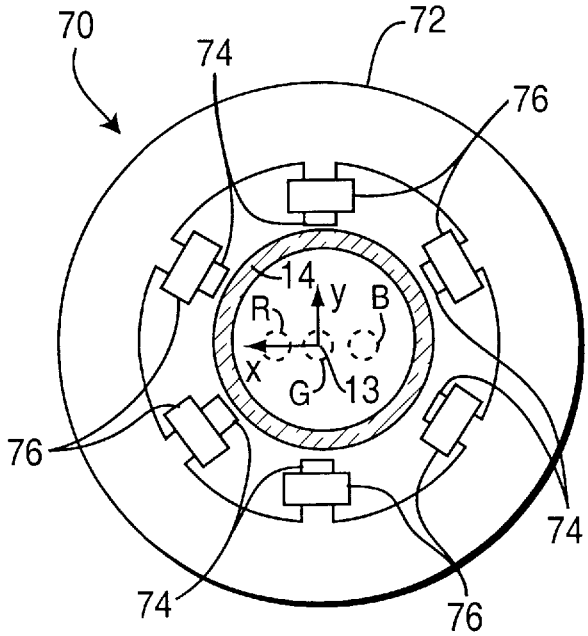
FIG. 5 is an end view schematic diagram of a six-pole coil of the invention.

FIG. 5 is an end view schematic diagram of a six-pole coil 70 of the invention disposed on tube neck 14. Six-pole coil 70 has a magnetic core 72 of generally toroidal shape that surrounds tube neck 14. Six radial pole pieces 76 are relatively evenly spaced around the inner surface of toroidal core 72 and extend radially inwardly therefrom 72 towards center line 13 of tube neck 14, which is also preferably the center of six-pole coil 70, so as to be proximate the external surface of neck 14. Core 72 and radial pole pieces 74 are typically a unitary core of a ferromagnetic material, such as a ferrite or silicon steel or other iron or steel. Suitable ferrite magnetic materials, such as manganese-zinc and magnesium-zinc ferrites, are available, for example, from TDK Corporation, Hitachi and FDK Corporation, all located in Japan, and D.G.P. Hinoday Industries located in India. The cross-section of core 72 and/or pole pieces may be circular, rectangular or other convenient shape. An electrical coil 76 wound of electrical wire, such as varnished or otherwise insulated copper magnet wire, is disposed on each of the pole pieces 74 and the six electrical coils 76 are typically electrically connected in series.

Six-pole coil 70 is rotationally oriented on tube neck 14 with a pole piece 76 in each of the 12 o'clock and 6 o'clock positions, i.e. along the +y and −y axes illustrated, which corresponds to the vertical direction when tube 10 is utilized in a typical orientation with the longer dimension of faceplate 20 in the horizontal direction. Electron gun 12 is oriented within tube neck 14 to produce three electron beams that travel in the z-axis direction, i.e. substantially parallel to centerline 13, in the x-z plane. The three beams all intersect the plane of the drawing of FIG. 5 at locations along the x axis, e.g., the green electron beam G typically being at the origin (i.e. at centerline 13, with red electron beam R being to the left thereof and blue electron beam B being to the right thereof.

Figure 6:
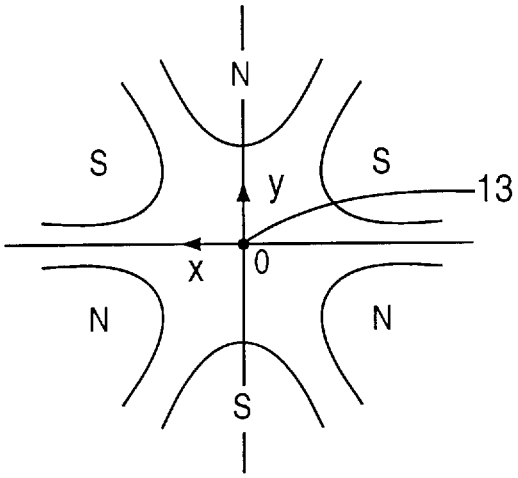
FIG. 6 is a graphical representation of the magnetic field distribution produced by the six-pole coil of FIG. 5.

FIG. 6 is a graphical representation of the magnetic field distribution produced by the six-pole coil 70 of FIG. 5 when an electrical current flows therethrough. The shape of the magnetic field distribution corresponds to the radial positions of field pieces 74 on which are the electrical coils 76 producing the desired electromagnetic field. The windings of coils 76 and direction of current flow therethrough produce a field with alternating N and S magnetic polarity that are evenly spaced radially about centerline 13. The strength of the electromagnetic field may be adjusted by either adjusting the number of turns on one or more of coils 76 or by adjusting the current flowing therethrough, as is convenient.

Figure 7:
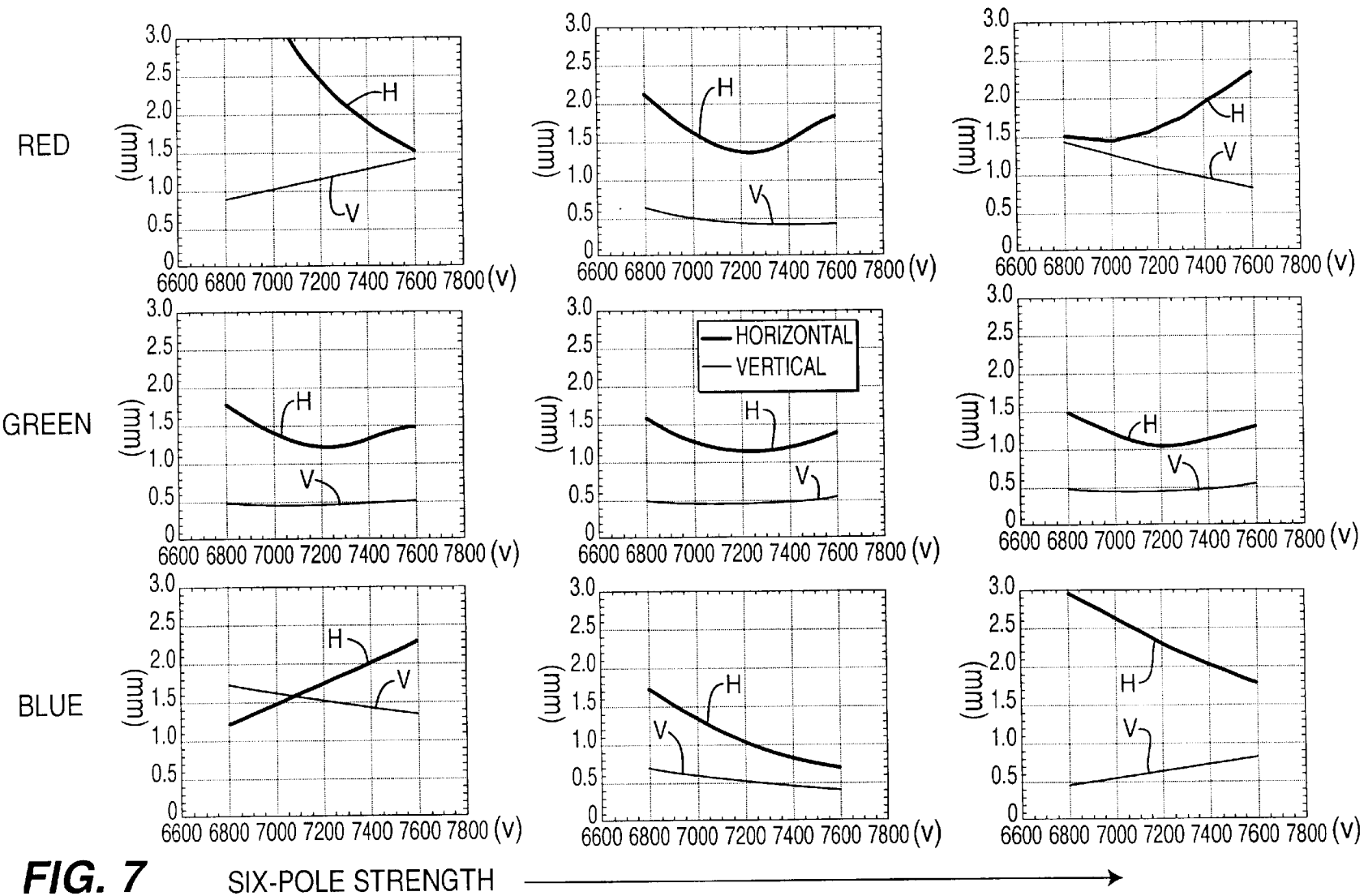
FIG. 7 are graphical representations illustrating relationships among the dimensions of the electron beam spot produced for the red, green and blue electron beams.

FIG. 7 includes graphical representations illustrating relationships among the dimensions of the electron beam spot produced for the red, green and blue electron beams R, G, B, under the influence of the six-pole filed produced by six-pole coil 70. In the array of nine graphical representations, the three in the top row are for red electron beam R, those in the center row are for green electron beam G, and those in the bottom row are for blue electron beam B. Also in the array, the three representations in the left hand column are for a given relatively low or weak six-pole field strength and those in the right hand column are for a relatively high or strong six-pole field strength. The three representations in the center column are for an intermediate six-pole field strength between the values associated with the right and left hand columns. In each representation, the vertical scale represents the dimension in millimeters of the spot produced by the particular electron beam, measured at the right edge of the screen periphery, on the contour defined by the 5%-of-peak-intensity of the particular electron beam, the horizontal scale represents the focus voltage, and the lines "H" and "V" represent the dimension of the spot in the horizontal direction and in the vertical dimension, respectively. It is noted that the "best" or ideal spot would have very small and equal dimensions in both the H and V directions, i.e. would be very small and circular.

Evaluation of space saving CRTs 10 indicated that a large asymmetry in the spots of the R, G, B electron beams exists at the periphery of screen 22, particularly at the left and right edges thereof at the "3:00 o'clock" or vertically centered position. Although the evaluation was not for an "optimized" electron gun, the results are representative for a typical deflection yoke that is relatively longer in the z-axis direction. The representations of the center row indicate that the best spot for the center green beam G is produced at a six-pole filed strength even greater than the relatively high filed strength represented by the right hand column, i.e. increasing six-pole field strength decreases the size of the green spot. However, such high field strength also undesirably produces increased asymmetry in both the red and blue spots. Such differences in spot size are undesirable and most likely result from differentials in the astigmatism characteristics affecting the three beams.

With the lower intermediate field strength depicted in the representations of the center column, however, such differential is substantially reduced, if not almost eliminated, and provides satisfactory focusing and symmetry of all three beams at the same conditions of deflection yoke 16 and electron gun 12. While the green spot size is not at its best or smallest, the slight increase in green spot size is minimal and will have little, if any, noticeable effect in the image produced by tube 10.

Figure 8:
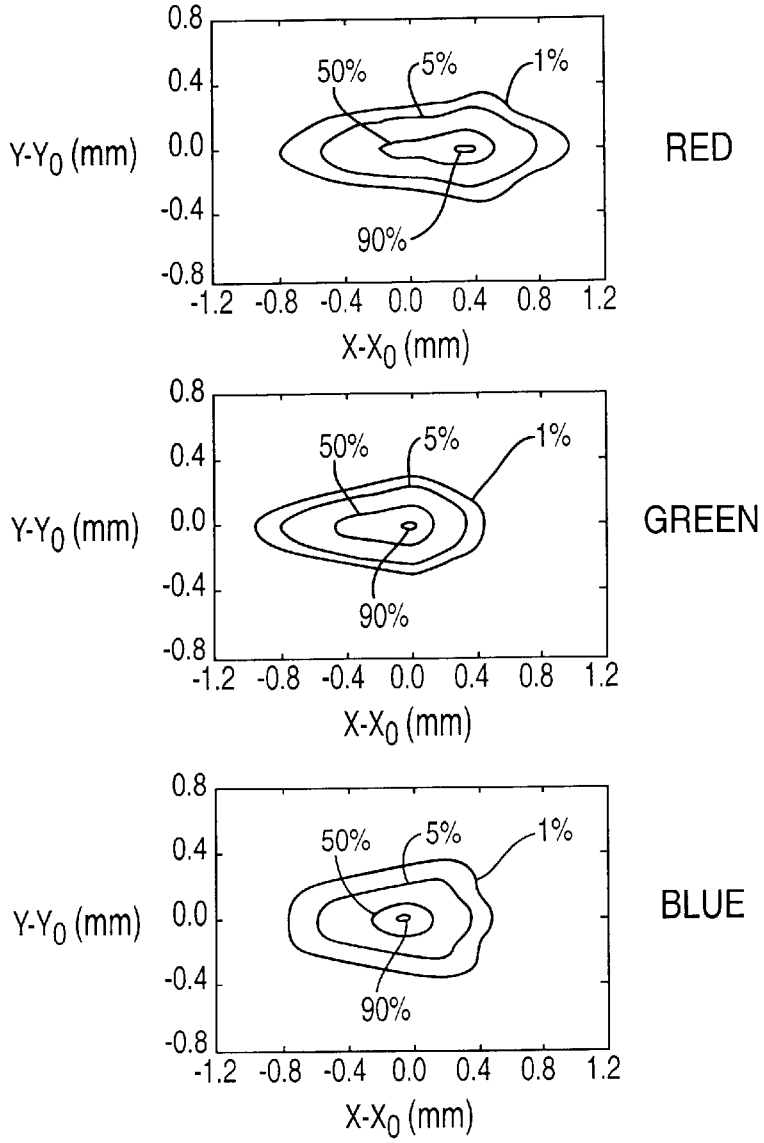
FIG. 8 are graphical representations of the intensity distribution contours of typical red, green and blue electron beam spots produced in accordance with the invention.

FIG. 8 are graphical representations of the intensity distribution contours of typical red R, green G and blue B electron beam spots produced in accordance with the invention at the 3:00 o'clock (center of the vertical edge of faceplate 20) under the conditions of the center column of graphical representations of FIG. 7. Each representation of FIG. 8 has a vertical and a horizontal scale in millimeters from the center thereof, i.e. "$X-X_0$" and "$Y-Y_0$" and the contours thereof are labeled at various percent-of-peak-intensity levels. Each spot has a satisfactory small spot size and a relatively uniform distribution. Spot sizes at the contour that represents the 5%-of-peak-intensity level of the electron beam are as follows:

| Color | Spot Width (mm) | Spot Height (mm) |
|---|---|---|
| Red | 1.33 | 0.43 |
| Green | 1.09 | 0.43 |
| Blue | 1.04 | 0.53 |

While the three respective beams are focused satisfactorily, although not perfectly circular or perfectly uniform, the convergence of the three beams onto the same spot is lacking. For example, the convergence between the red R and blue B electron beams is offset or spaced apart by about 40 mm, i.e. due to about 20 mm spacing between the R and G beams and about 20 mm spacing between the G and B beams, due to loss of convergence in deflection yoke 16. Such convergence errors can be corrected in several ways, as described below.

Figure 9:
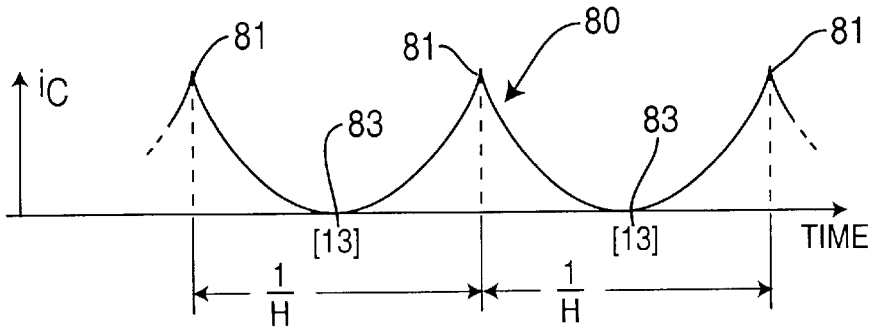
FIG. 9 is a graphical representation of a typical waveform as a function of time of current flowing in the six-pole coil according to the invention.

FIG. 9 is a graphical representation of a typical waveform 80 as a function of time of current $i_C$ flowing in six-pole coil 70 according to the invention. Because the coils 76 of six-pole coil 70 are series connected, current $i_C$ flows in all six coils 76 thereof. Because the needed correction is greatest at the vertical edges of screen 22 and little or no correction is needed at the center thereof, current $i_C$ has a maximum value 81 when the scanning of electron beam 30 is at such vertical edges and has a minimum value 83, e.g., zero, when the scanning of electron beam 30 is at the center 13 of screen 22. The waveform 80 of current $i_C$ thus repeats at the same rate as the horizontal scanning rate H, and the time between successive maximum values 81 or between successive minimum values 83 is 1/H.

Convergence errors, such as the 20 mm+20 mm=40 mm mis-convergence between the R, G and B electron beams 30 described above, may be corrected or counteracted in several ways. Two exemplary corrections include: digital correction of the R, G, B video signals SR, SG, SB, respectively, as part of the processing of the video signal prior to it being applied to the R, G, B control grids of tube 10, and dynamic correction in the electron gun and/or in the deflection yoke.

Digital correction of the R, G, B video signals SR, SG, SB, respectively, in processing the video signal applied to the R, G, B control grids of tube 10 can provide essentially perfect correction of the mis-convergence and so is preferred. Referring again to FIG. 1, video digital signals representing video pixel information are stored in memory 90 organized with respect to their pixel location in the image frame to be displayed. The pixel information is predistorted and then reorganized, either as it is written into memory 90 or is read out therefrom. Such predistortion may include, e.g., modifying the value thereof in accordance with a desired transform. Such reorganization may simply involve writing and reading the pixel information in a different order or with a different timing.

In other words, the received pixel information including red, green and blue sub-pixel information is organized with each sub-pixel of information associated with a position corresponding to its proper position in the image to be displayed. As predistorted and/or reorganized, video pixel information is produced from memory 90 separately and independently for each of the red, green and blue sub-pixels, respectively. Red, green and blue sub-pixel information is produced in an order and with timing corresponding to the actual position of the scanning red, green and blue electron beams on a scan line, respectively, taking into account their mis-convergence upon landing on screen 22, rather than with red, green and blue sub-pixel information for a given pixel being produced at the same time as would be proper if all three of the red, green and blue electron beams converged on the same landing spot.

It is noted that modem television receivers for receiving digital television signals typically include memory for storing digital video information as the digital video signals are demodulated and processed. In a high-definition television (HDTV) receiver, such memory is typically a frame store memory and so no additional memory is required to implement the described digital convergence correction. Lesser memory capacity, such as a partial frame store memory or one or more line store memories may also be employed to effect such digital convergence correction.

Dynamic convergence correction may be implemented by modifying the electromagnetic field produced by deflection yoke 16, e.g., as by modifying the deflection drive signal or by applying an additional deflection correction signal to an auxiliary or correction winding, or by dynamically varying the focusing signal applied to the focusing grid or grids of electron gun 12, as are known in the art.

Figure 10:
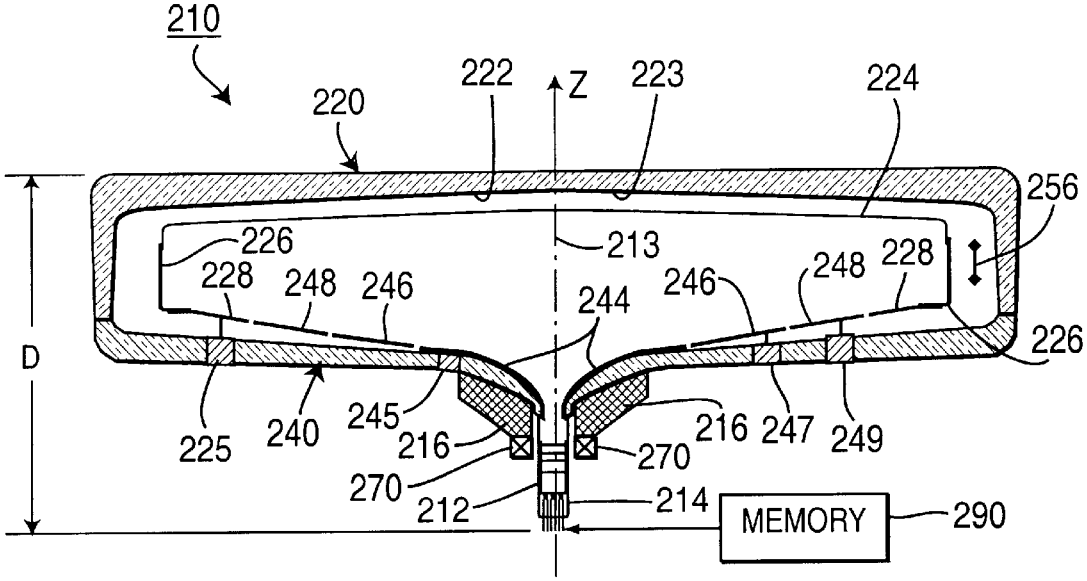
FIGS. 10 and 11 are cross-sectional diagrams illustrating alternative exemplary embodiments of arrangements providing appropriately positioned electrodes within a cathode ray tube in accordance with the invention.

FIG. 10 is a cross-sectional diagram of an alternative exemplary cathode ray tube 210 showing an alternative arrangement for appropriately positioning a set of electrodes 244, 246, 248 mounted within the interior of funnel-shaped glass bulb 240 to deflect an electron beam (not shown) to land on screen electrode 222 and phosphors 223 as described above in relation to tube 10. Electron gun 212, neck 214, faceplate 220, phosphors 223, shadow mask 224, mask frame 226, and funnel-shaped glass bulb 240 are disposed symmetrically relative to centerline 213, and may include a getter material 256 in a convenient location in the space between glass bulb 240 and one or more of metal electrodes 246, 248, mask frame 226 and mask frame shield 228, all of the foregoing being substantially as described above. Six-pole coil 270 and memory 290 correspond to and function in like manner to six-pole coil and memory 90 described above.

Stamped metal mask shield 228 and stamped metal electrodes 246, 248 are formed as a set of mirror-image plates and/or loops of ascending dimension and are positioned symmetrically with respect to tube central axis 213 with the smallest proximate neck 214 and the largest proximate mask frame 226 and faceplate 220. Mask frame 226 is a relatively rigid metal structure attached to the interior of faceplate 220, such as by metal clips or by embedment in glass support features such as glass beads or lips on the interior surface of faceplate 220, and provides support for mask shield 228 and for electrodes 246 and 248 attached thereto Typically, two or more supports 252 (not visible in FIG. 10) of an insulating material bridge the gap between mask shield 228 and electrode 248 for providing electrically insulating support therebetween to hold mask shield 228 and electrode 248 in a desired relative position. Similarly, two or more additional supports 252 (not visible in FIG. 10) of an insulating material bridge the gap between electrode 246 and electrode 248 for providing electrically insulating support therebetween to hold electrode 246 and 248 in a desired relative position. Each of mask shield 228 and electrodes 246, 248 is electrically isolated from the other ones thereof, unless it is desired that two or more of mask shield 228 and electrodes 246, 248 be at the same bias potential.

In a typical tube 210 having an about 81 cm (about 32-inch) diagonal faceplate 220 in a 16:9 wide-format aspect ratio, depth D is about 28 cm (about 11 inches). Screen 222, mask 224, mask support 226 and mask shield 228 are biased to a potential of about 28–32 kV, and typically 30 kV, via high-voltage conductor 225 (i.e. "button" 225) penetrating glass bulb 240. Coated neck region electrode 244 is biased in a range of about 18–24 kV, typically 22 kV, applied via button 245. High voltage electrode 246 is biased to a potential higher than the screen bias potential in a range of about 30–35 kV, typically 35 kV, applied via button 247, for increasing the electron-beam deflection provided by deflection yoke 216. Electrode 248 is biased to a potential less than the screen bias potential in a rang of about 18–24 kV, typically 22 kV, applied via button 249, for directing the electron beam in the peripheral region near the edges of faceplate 220 towards faceplate 220.

Figure 11:
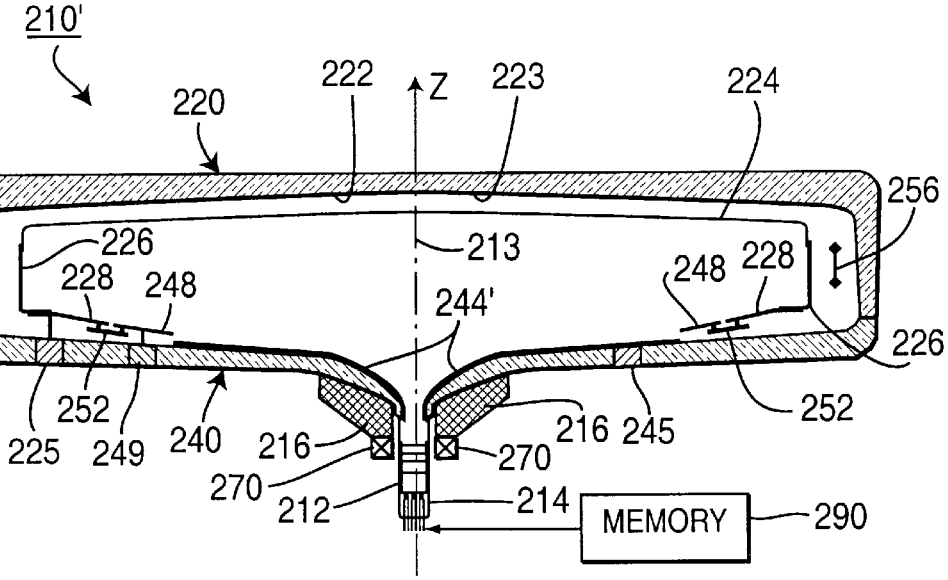

FIG. 11 is a cross-sectional diagram illustrating alternative exemplary arrangement of appropriately positioned electrodes 244, 248 within a cathode ray tube 210' in accordance with the invention. Tube 210' is like tube 210 of FIG. 10 except that stamped metal electrode 246 is eliminated and coated neck electrode 244' extends to cover the portion of the interior surface of glass bulb 240 that was behind and thus shielded by electrode 246 in tube 210. Visible therein is support 252 which is typically a ceramic support fused or otherwise attached to mask shield 228 and electrode 240 for supporting same in desired relative positions.

Neck electrode 244' is biased at the same potential as is screen electrode 222 in tube 210 and may extend to carry such bias potential applied via button 245 to screen electrode 222, mask 224, mask frame 226 and mask shield 228, e.g., such as via a metal clip thereon or other connection. Electrode 248 is biased via button 249 in like manner to tube 210. in any of the tubes 10, 210, 210' and so on, high voltage feedthrough buttons 25, 45, 47, 49, 225, 245, 247, 249 may be positioned to penetrate glass tube envelope 40, 240 at any convenient location. Six-pole coil 270 and memory 290 correspond to and function in like manner to six-pole coil and memory 90 described above.

Figure 12:
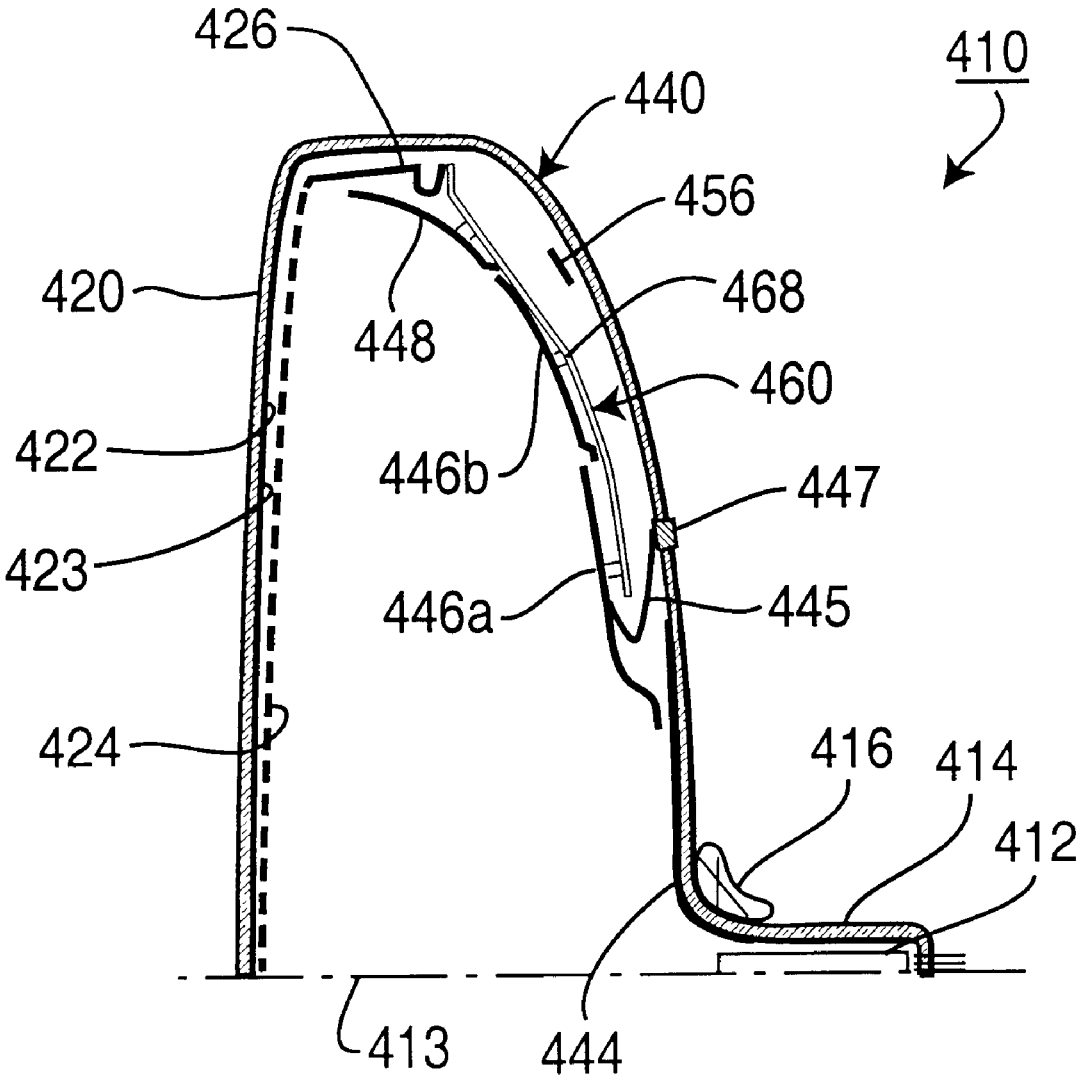
FIG. 12 is a partial cross-sectional diagram of an alternative exemplary structure providing appropriately positioned electrodes within a cathode ray tube in accordance with the invention.

FIG. 12 is a partial cross-sectional diagram of an alternative exemplary structure providing appropriately positioned electrodes 446*a*, 446*b*, 448 within a cathode ray tube 410 in accordance with the invention. Faceplate 420, glass tube bulb 440, neck 414, electron gun 412, magnetic deflection yoke 416, faceplate 420, screen electrode 422, phosphors 423, shadow mask 424, and shadow mask frame 426 are as described above in relation to tube 10.

Sprayed or deposited neck electrode 444 is biased at a potential not exceeding the screen potential, and preferably less than screen potential, e.g., typically 10–20 kV and typically 15 kV. Plural electrostatic deflection electrodes 446*a*, 446*b*, 448 are adapted to be biased at different potentials and are spaced away from the wall of tube envelope 440 and attached to support member 460 by respective welds 468: A high positive potential, e.g., 35 kV, is applied via feedthrough 447 and electrically-conductive support 445 to electrode 446*a* for increasing the deflection of electrons highly deflected by deflection yoke 416. Support member 460 includes a voltage divider as described above to develop bias potentials for electrodes 446*b* and 448. Electrode 448 is biased to a potential less than the screen potential, e.g., 0–20 kV and typically 10 kV, while electrode 446*b* may be biased to the potential of electrode 446*a* or that of electrode 448, e.g., 35 kV and 10 kV, respectively. Getter material 456 is positioned as convenient behind electrodes 446*a*, 446*b*, 448 and support 460.

While the present invention has been described in terms of the foregoing exemplary embodiments, variations within the scope and spirit of the present invention as defined by the claims following will be apparent to those skilled in the art. For example, six-pole coil 70 may employ coils that are identical of that are different, so as to provide an electromagnetic field of the desired shape and magnitude. Similarly, coils 76 may be connected in series and so be driven by the same current waveform, or may be in various other series and/or parallel connections so as to be driven by current waveforms of different magnitude and/or shape, so as to provide an electromagnetic field of the desired shape and magnitude.

Further, relative focusing of the three beams as described need not be effected solely by applying a current waveform 80 of the general shape illustrated in FIG. 9 at the horizontal line scanning rate, but may also effected by additionally changing the shape and/or amplitude of the current waveform 80 in relation to the vertical scanning rate.

While the bias potential applied to the peripheral electrode 48 is preferably less than the screen potential, it may be equal thereto, may be less than the bias potential of neck electrode 44 and may even be at zero or ground potential or negative.

What is claimed is:

1. A cathode ray tube comprising:

a tube envelope having a generally flat faceplate and a screen electrode on the faceplate biased at a screen potential, having a tube neck opposite said faceplate, and having a tube funnel joining said tube neck and said faceplate;

in said tube neck, a source of three electron beams in line directed to impinge on said faceplate, wherein the three electron beams in line are substantially parallel in a defined plane in said tube neck;

a deflection yoke proximate said tube funnel for deflecting the three electron beams from said source over a given range of deflection angles, whereby the deflected electron beams are scanned to impinge upon a given area of the screen electrode;

a shadow mask proximate said faceplate having a plurality of apertures therethrough, wherein said shadow mask is biased at said screen potential;

a pattern of three different phosphorescent materials disposed on said faceplate for producing different respective colors of light in response to the three electron beams impinging thereon;

an electromagnet having six poles disposed around said tube neck intermediate said source of three electron beams and said deflection yoke for focusing each of said three electron beams on said faceplate when said three electron beams are deflected to impinge on said faceplate near its periphery;

a first electrode on an interior surface of the tube funnel of said tube envelope, said first electrode defining an aperture through which the deflected three beams of electrons pass, wherein said first electrode is intermediate said deflection yoke and said faceplate and is biased at a potential exceeding the screen potential; and a second electrode on the interior surface of said tube funnel defining an aperture through which the three beams of electrons pass, wherein said second electrode is proximate said tube neck between said electromagnet and said first electrode and is biased at a second potential less than the screen potential;

whereby the deflected electron beams are additionally deflected by said first electrode and are focused near the periphery of said faceplate by said six-pole electromagnet.

2. A cathode ray tube comprising:

a tube envelope having a generally flat faceplate and a screen electrode on the faceplate biased at a screen potential, having a tube neck opposite said faceplate, and having a tube funnel joining said tube neck and said faceplate;

in said tube neck, a source of three electron beams in line directed to impinge on said faceplate, wherein the three electron beams in line are substantially parallel in a defined plane in said tube neck;

a deflection yoke proximate said tube funnel for deflecting the three electron beams from said source over a given range of deflection angles, whereby the deflected electron beams are scanned to impinge upon a given area of the screen electrode;

a shadow mask proximate said faceplate having a plurality of apertures therethrough, wherein said shadow mask is biased at said screen potential;

a pattern of three different phosphorescent materials disposed on said faceplate for producing different respective colors of light in response to the three electron beams impinging thereon;

an electromagnet having six poles disposed around said tube neck intermediate said source of three electron beams and said deflection yoke for focusing each of said three electron beams on said faceplate when said three electron beams are deflected to impinge on said faceplate near its periphery;

a first electrode on an interior surface of the tube funnel of said tube envelope, said first electrode defining an aperture through which the deflected three beams of electrons pass, wherein said first electrode is intermediate said deflection yoke and said faceplate and is biased at a potential exceeding the screen potential; and a formed metal electrode on the interior surface of said tube funnel defining an aperture through which the three beams of electrons pass, wherein said formed metal electrode is between said first electrode and said faceplate and is biased at a second potential less than the screen potential;

whereby the deflected electron beams are additionally deflected by said first electrode and are focused near the periphery of said faceplate by said six-pole electromagnet.

* * * * *